United States Patent [19]

Price

[11] Patent Number: 4,988,323

[45] Date of Patent: Jan. 29, 1991

[54] WRESTLER CHARACTER FIGURE

[75] Inventor: Daniel W. Price, Chepachet, R.I.

[73] Assignee: Hasbro, Inc., Pawtucket, R.I.

[21] Appl. No.: 475,847

[22] Filed: Feb. 6, 1990

[51] Int. Cl.[5] ..... A63H 13/06

[52] U.S. Cl. ..... 446/334; 446/336

[58] Field of Search ..... 446/334, 336, 330, 335, 446/379, 317, 353, 365

[56] References Cited

U.S. PATENT DOCUMENTS

| | | | |
|---|---|---|---|
| 3,053,008 | 9/1962 | Pelunis | 446/330 |
| 3,699,713 | 10/1972 | Sapkus et al. | 446/330 |
| 4,579,543 | 4/1986 | Renger et al. | 446/334 |
| 4,601,672 | 7/1986 | Cook et al. | 446/330 |
| 4,605,382 | 8/1986 | Cook et al. | 446/330 |
| 4,608,026 | 8/1986 | Newton et al. | 446/330 |
| 4,623,318 | 11/1986 | Tsiknopoulos et al. | 446/330 |

OTHER PUBLICATIONS

"Amusement Business", p. 13A, Jun. 1986, Wrestling Figures by Dan Brechner & Co.

*Primary Examiner*—Mickey Yu

*Attorney, Agent, or Firm*—Salter & Michaelson

[57] ABSTRACT

A wrestler character figure includes a free standing main body member, including a torso portion and a first arm portion on the torso portion. The first arm member is operable for securing an opponent character figure in a headlock position wherein the head of the opponent character figure is positioned at least partially in front of the torso portion. The wrestler character figure further includes a second arm portion which is pivotable about an axis in the torso portion for moving a hand on the second arm portion toward and away from the head of the opponent character figure. The second arm portion is biased in a direction wherein the hand is advanced toward the head of the opponent character figure to inflict a simulated punching action on the head of the opponent character figure.

1 Claim, 2 Drawing Sheets

WRESTLER CHARACTER FIGURE

BACKGROUND AND SUMMARY OF THE INVENTION

The instant invention relates to action character figures and more particularly to a wrestler character figure which is adapted to perform a predetermined wrestling maneuver.

It has generally been found that professional wrestling has a relatively high level of appeal among children as well as among persons of various other age groups. Further, it has been found that certain professional wrestling characters have gained significant recognition among children as a result of their identification with certain specific wrestling maneuvers. However, heretofore the toy industry has generally failed to provide an effective action character figure which is capable of performing one or more of the types of wrestling maneuvers commonly performed by professional wrestlers. As a result, while children have often gained significant enjoyment from watching the performances of professional wrestling characters, heretofore it has generally not been possible for children to effectively simulate the performances of professional wrestling characters in play environments utilizing action character figures.

The instant invention provides a relatively simple, yet highly amusing, action character figure which is specifically adapted for performing a predetermined wrestling maneuver. In particular, the instant invention provides an action character figure which is adapted for performing a headlock maneuver on an opponent character figure and for then performing a simulated punching maneuver which is directed at the head of the opponent character figure. More specifically, the wrestler character figure of the instant invention comprises a free standing main body portion, including a pair of leg portions, a torso portion and a head and neck portion, and first and second arm members on the torso portion. The first arm member is constructed and mounted so that it is positionable in a headlock hold position, wherein it extends around the neck of an opponent character figure for securing the opponent character figure in a headlock position, wherein the head of the opponent character figure is positioned at least partially in front of the torso portion of the main body member. The second ar member preferably includes substantially straight upper and lower second arm member sections which are joined in angular relation at an elbow and a hand portion on the lower arm section. The second arm member is pivotally mounted on the torso portion so that it is pivotable for moving the hand portion in a direction toward the head of an opponent character figure secured in the headlock position. The second arm member is preferably pivotable about a substantially vertical axis in the torso portion, and the second arm member is biased by an internal spring in the torso portion for biasing the hand portion toward the head of the opponent character figure secured in the headlock position. The first arm member is preferably formed in a substantially rigid construction, wherein it extends outwardly to an elbow and then back toward the torso portion when the first arm member is in the headlock hold position, and the first arm member is preferably pivotally mounted on the torso portion about a substantially horizontal axis. The second arm member is preferably also formed in a substantially rigid construction and it is preferably attached to a lever arm which is pivotally mounted about a substantially vertical axis in the torso portion for moving the hand portion toward the head of an opponent character figure secured in the headlock position.

Accordingly, for use and operation of the wrestler character figure of the instant invention the head of an opponent character figure is secured in the headlock position with the first arm member, so that the head of the opponent character figure is located at least partially in front of the torso portion of the body member. The second arm member is then manually drawn rearwardly against the biasing force of the spring in the interior of the torso portion. Upon releasing the second arm member, the second arm member is pivoted forwardly to cause the hand portion thereon to be moved in a path across the front of the torso portion toward the head of the opponent character figure to simulate a punching action which is directed at the head of the opponent character figure. Further, by repeatedly and rapidly drawing the second arm portion rearwardly and releasing it, a simulated wrestling maneuver can be performed, wherein the head of the opponent character figure is repeatedly punched in rapid succession.

The closest prior art to the subject invention of which the applicant is aware is disclosed in the U.S. Pat. Nos. 4,579,543 to Renger et al; 4,601,672 to Cook et al; 4,608,026 to Newton et al; 4,605,382 to Cook et al; and 4,623,318 to Tsiknopoulos et al. However, since these references fail to disclose or suggest an action character figure which is capable of performing a headlock wrestling maneuver they are believed to be of only general interest with respect to the wrestler character figure of the subject invention. In this regard, it is specifically noted that the above references fail to teach a wrestler character figure which is capable of holding the head of an opponent character figure in a headlock position while a simulated punching activity is directed at the head of the opponent character figure.

Accordingly, it is a primary object of the instant invention to provide an action character figure which is operative for performing a predetermined wrestling maneuver.

Another object of the instant invention is to provide an action character figure which is capable of securing an opponent character figure in a headlock position while a simulated punching action is directed at the head of the opponent character figure.

An even further object of the instant invention is to provide an action character figure which is adapted to simulate a professional wrestling character figure.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
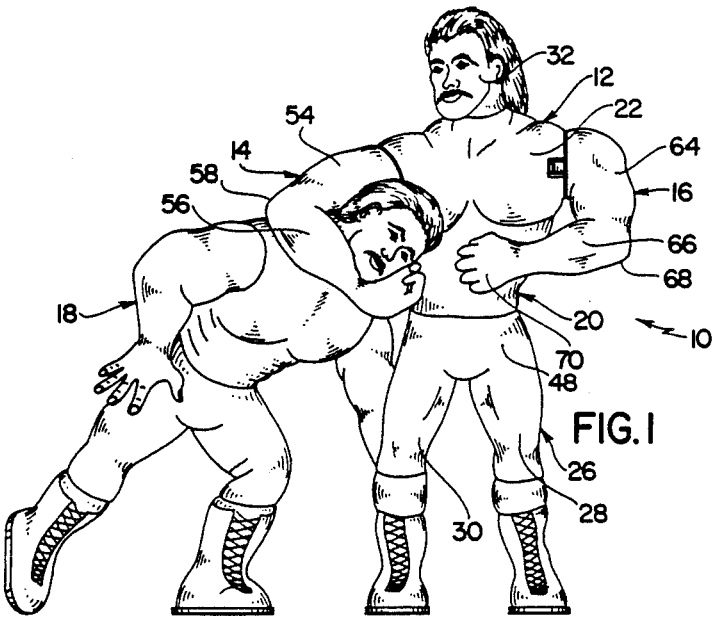
FIG. 1 is a perspective view of the wrestler character figure of the instant invention with an opponent character figure secured in the headlock position.
Figure 2:
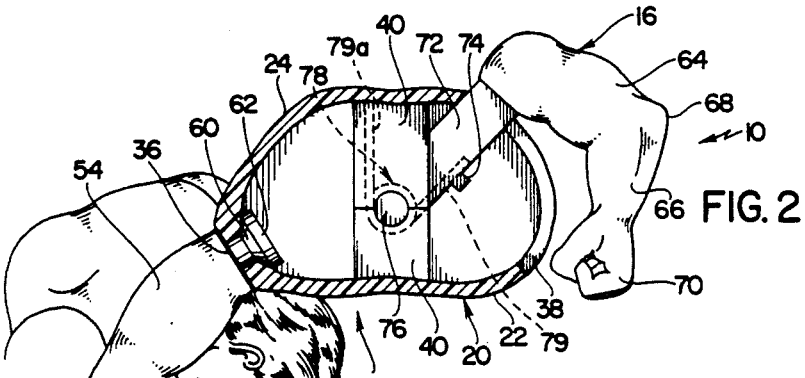
FIGS. 2 and 3 are horizontal sectional views illustrating the operation of the wrestler character figure for inflicting a punching action upon the head of the opponent character figure.
Figure 3:
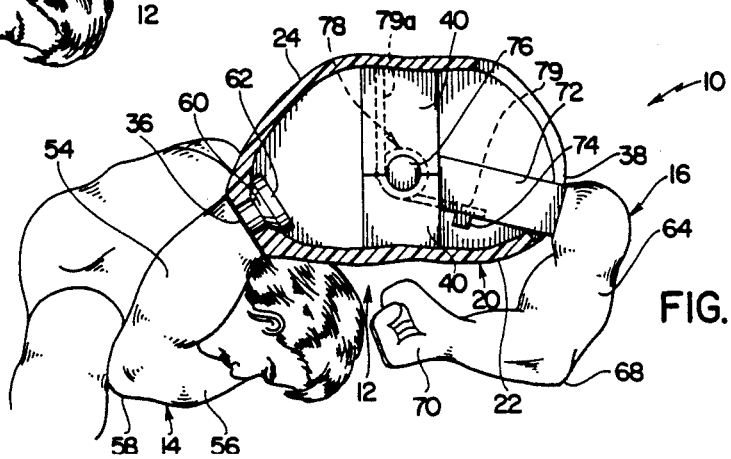

Referring now to the drawings, the wrestler character figure of the instant invention is illustrated and generally indicated at 10 in FIGS. 1–4. The wrestler character FIG. 10 comprises a main body member generally indicated at 12, a first arm assembly generally indicated at 14 and a second arm assembly generally indicated at 16. As illustrated in FIGS. 1–3, the wrestler character FIG. 10 is operative in combination with an opponent character figure generally indicated at 18 for applying a prespecified wrestling maneuver to the opponent character FIG. 18. Specifically, the wrestler character FIG. 10 is operative for securing the head of the opponent character FIG. 18 in a headlock position with the first arm assembly 14 and for directing a punching activity at the head of the opponent character FIG. 18 with the second arm assembly 16.

The main body member 12 is preferably constructed to resemble the main body portion of a muscular wrestling character and it includes a torso portion generally indicated at 20 comprising front and rear torso shell portions 22 and 24, respectively, a leg portion generally indicated at 26 including first and second leg elements 28 and 30, respectively, and a head and neck portion 32.

Figure 4:
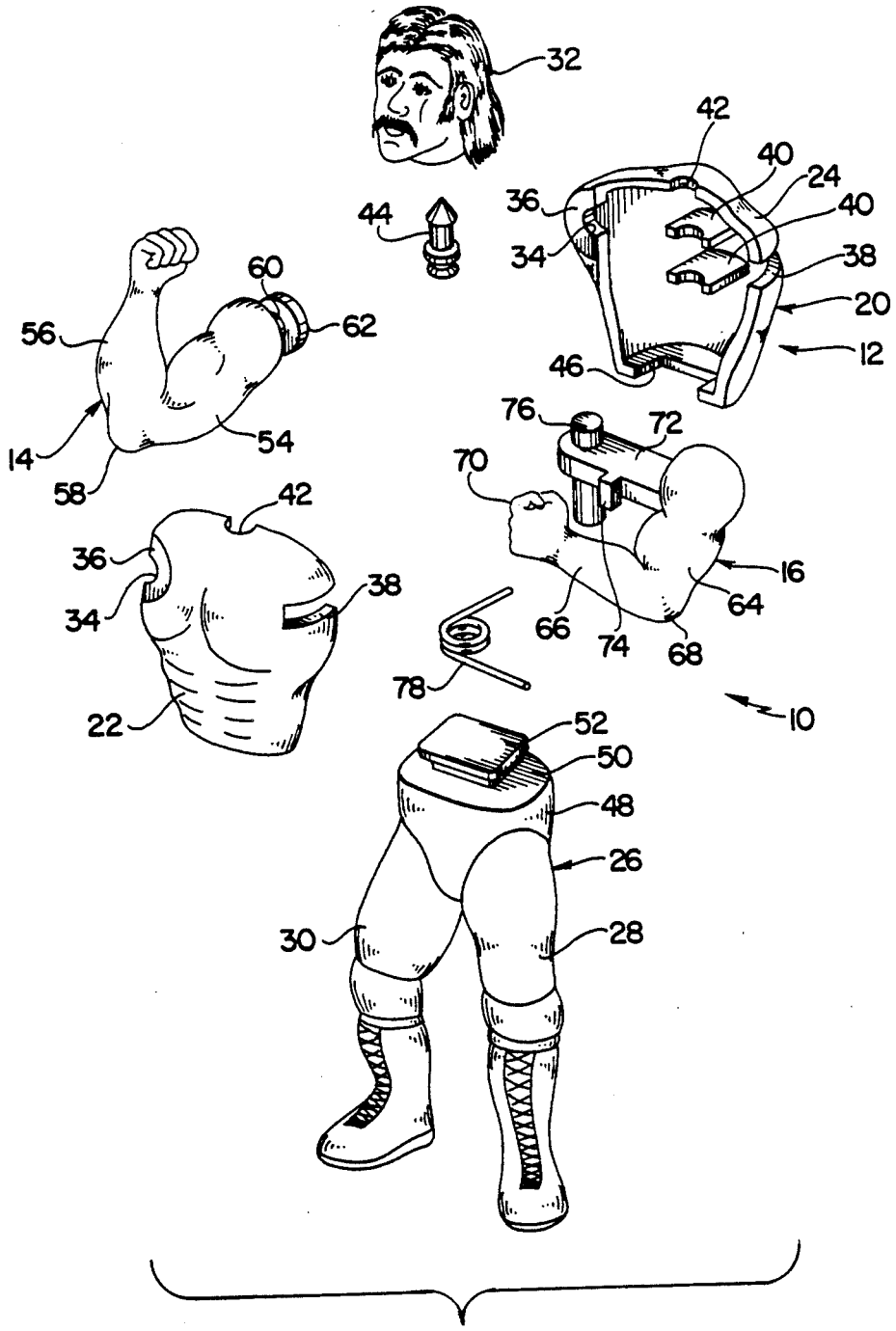
FIG. 4 is an exploded perspective view of the wrestler character figure.

The torso portion 20 includes a right arm socket 34 which is preferably angled forwardly at least slightly, and a right arm socket face 36 which extends around the socket 34. As illustrated in FIG. 4, the socket 34 and the socket face 36 are both defined partially by the front shell portion 22 and partially by the rear shell portion 24. A substantially horizontally extending left arm slot 38 is formed on the left side of the torso portion 20 so that it extends forwardly a distance in the front shell portion 22 and rearwardly a distance in the rear shell portion 24. A pair of left arm pivot mounts 40 is formed in each of the front and rear shell portions 22 and 24, respectively, so that the mounts 40 are operative for rotatably mounting the left or second arm assembly 16 about a substantially vertical axis as will hereinafter be more fully set forth. A neck socket 42 is also formed in the torso portion 20 so that it is partially defined by each of the front and rear shell portions 22 and 24, respectively, and the head and neck portion 32 is rotatably mounted on the torso portion 20 with a pin 44 which is received in the socket 42. A substantially rectangular mounting opening 46 which is partially defined by each of the front and rear shell portions 22 and 24, respectively, is formed at the lower end of the torso portion 20.

The leg portion 26 comprises the leg elements 28 and 30 and an abdomen section 48. A substantially flat mounting surface 50 is formed at the upper end of the abdomen section 48 and a rectangular mounting post 52 having an enlarged end projects upwardly from the mounting surface 50. The torso portion 20 is mounted on the abdomen section 48 so that it is received on the surface 50 and so that the mounting post 52 is captured in the opening 46 for non-rotatably securing the torso portion 20 on the leg portion 26.

The first or right arm assembly 14 is preferably integrally molded from a suitable plastic material and it is preferably formed in the configuration of a human right arm comprising upper and lower arm portions 54 and 56, respectively, which are joined in angular relation at an elbow 58. The first arm assembly 14 further includes a cylindrical mounting member 60 at the upper end thereof, the mounting member 60 including an enlarged cylindrical terminal element 62. The first arm assembly 14 is assembled with the torso portion 20, so that the mounting member 60 is received in the mounting socket 34 and retained by the terminal element 62 to enable the first arm assembly 14 to be rotated about a substantially horizontal axis. Accordingly, the first arm assembly 14 is rotatable between a muscle flexing position wherein the lower arm portion 56 extends upwardly and inwardly from the elbow 58 toward the head and neck portion 32 or a headlock position wherein the lower arm portion 56 extends downwardly and inwardly toward the torso portion 20 from the elbow 58.

The second or left arm assembly 16 comprises upper and lower arm portions 64 and 66, respectively, an elbow 68 and a clenched fist or hand section 70 on the lower arm portion 66. The upper end of the upper left arm portion 64 is joined to a lever arm 72 having a lug 74 thereon and a cylindrical post 76 extends downwardly from the lever arm 72. The left arm assembly 16 is mounted on the torso portion 20 so that the post 76 is rotatably received in the mounts 40, and so that the lever arm 72 projects outwardly through the slot 38. As a result, the left arm assembly 16 is pivotable about a substantially vertical axis as defined by the post 76. A torsion spring 78 which is received on the post 76 includes a first end portion 79 which is received in a downwardly facing notch in the lug 74. As illustrated in FIGS. 2 and 3, the spring 78 also includes a second end portion **79*a* which is received in engagement with the torso portion 20 so that the spring 78 is operative for biasing the second arm assembly 16 toward the forwardly pivoted position illustrated in FIG. 3. Accordingly, by manually drawing the second arm assembly 16 rearwardly against the biasing force of the spring 78 to the loaded position illustrated in FIG. 2 and then releasing the second arm assembly 16, the second arm assembly 16 is propelled toward a forwardly pivoted position by the spring 78. As the second arm assembly is pivoted forwardly in this manner, the hand section 70 is moved in a path extending across the front of the torso portion 20 in the general direction of the first arm portion 14**.

The opponent character FIG. 18 is preferably also formed in the configuration of a professional wrestler character, and it is preferably of approximately the same size as the wrestler character FIG. 10. The opponent character figure is configured so that it is receivable in the headlock position illustrated in FIGS. 1–3, wherein the first arm portion 14 extends around the neck of the opponent character FIG. 18.

Accordingly, for use and operation of the wrestler character FIG. 10 the first arm assembly 14 is oriented so that it extends around the neck of the opponent character FIG. 18 to secure the character FIG. 18 in the headlock position illustrated in FIGS. 1–3. The second or left arm assembly 16 of the wrestler character FIG. 10 is then manually drawn rearwardly against the force of the spring 78 and then the second arm assembly 16 is released, so that the second arm portion 16 is pivoted forwardly about the axis of the post 76 causing the hand section 70 to be advanced in a path extending across the front of the torso portion 20 toward the head of the opponent character FIG. 18. Accordingly, by manipulating the second arm assembly 16 the character FIG. 10 can be operated to inflict a simulated punching action on the head of the opponent character FIG. 18 with the hand section 70 while the opponent character FIG.

18 is maintained in the headlock position with the first arm assembly 14.

Accordingly, it is seen that the wrestler character FIG. 10 is effectively adapted to perform an amusing wrestling maneuver on an opponent character figure. Specifically, the wrestler character FIG. 10 is adapted to inflict a simulated punching action upon the head of the opponent character FIG. 18 while the opponent character FIG. 18 is secured in the headlock position. Accordingly, the wrestler character FIG. 10 can be effectively utilized in a simulated professional wrestling play theme for simulating the activities of a professional wrestling character. As a result the wrestling character FIG. 10 has a high level of play value which is significantly enhanced by the unique action maneuvers of which it is capable. Hence, it is seen that the instant invention represents a significant advancement in the toy art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A wrestler character figure comprising:

(a) a free standing main body member including a pair of leg portions, a torso portion supported on said leg portions, said torso portion including first and second shoulders and a waist, and a head and neck portion supported on said torso portion above said shoulders;

(b) first arm portion means pivotally attached to said torso portion adjacent said first shoulder, said first arm portion means being positionable in a headlock hold position, wherein said first arm portion means extends outwardly and downwardly from said torso portion and then back inwardly and further downwardly toward said torso portion for securing an opponent character figure in a headlock position with the head of said opponent character figure located at least partially in the front of said torso portion; and (c) second arm portion means on said torso portion, said second arm portion means including substantially straight upper and lower second arm sections, an elbow section joining said upper and lower second arm sections and a hand section on said lower second arm section, said second arm portion means further including pivot means pivotally joining said upper second arm section to said torso portion adjacent said second shoulder so that said upper second arm section extends downwardly therefrom to said elbow section, said elbow section being located at an elevation which is approximately midway between the elevation of said second shoulder and the elevation of said waist, said lower second arm section normally extending angularly forwardly and across the front of said torso portion from said elbow section in a substantially horizontal disposition toward the head of said opponent character figure when said opponent character figure is secured in the headlock position, said pivot means pivotally joining said upper second arm section to said torso portion so that said second arm portion is pivotable about a substantially vertical axis in said torso portion, and means biasing said second arm portion so that said hand section is biased toward the head of said opponent character figure when said opponent character figure is secured in the headlock position.

* * * * *